US005260744A

United States Patent [19]

Nishimori

[11] Patent Number: 5,260,744

[45] Date of Patent: Nov. 9, 1993

[54] MULTI-FUNCTION ELECTRONIC DEVICE AND METHOD OF SETTING THE FUNCTION THEREOF

[75] Inventor: Kadotaro Nishimori, Nagoya, Japan

[73] Assignee: Minolta Camera Kabushiki Kaisha, Osaka, Japan

[21] Appl. No.: 840,803

[22] Filed: Feb. 25, 1992

[30] Foreign Application Priority Data

Feb. 28, 1991 [JP] Japan ..... 3-059749

[51] Int. Cl.[5] ..... G03G 15/00

[52] U.S. Cl. ..... 355/206; 355/203; 345/133; 345/141; 395/155

[58] Field of Search ..... 355/204, 206, 208, 203, 355/205, 207, 209; 340/700, 713, 706, 718, 711; 364/518, 900

[56] References Cited

U.S. PATENT DOCUMENTS 4,327,994 5/1982 Barley et al. ..... 355/14 R
4,393,375 7/1983 Sugiura et al. ..... 340/700
4,738,523 4/1988 Ito et al. ..... 353/26 R
4,816,868 3/1989 Shimizu et al. ..... 355/204 X
4,944,031 7/1990 Yoshino et al. ..... 355/206

*Primary Examiner*—A. T. Grimley
*Assistant Examiner*—T. A. Dang
*Attorney, Agent, or Firm*—Burns, Doane, Swecker & Mathis

[57] ABSTRACT

The present invention relates to a selection setting method for various types of office automation equipment, with the object of simplifying the selection of functions provided by the equipment. A function setting method for setting predetermined values corresponding to a plurality of functions provided by an apparatus 1 in accordance with message displays displayed on a display 71. The function setting method provides message displays GP, GM or GR corresponding to the most important elements of the functions and which are displayed in prioritized order in accordance with the purpose for which the apparatus 1 is to be used.

10 Claims, 30 Drawing Sheets

MULTI-FUNCTION ELECTRONIC DEVICE AND METHOD OF SETTING THE FUNCTION THEREOF

BACKGROUND OF THE INVENTION

1. Field of the Invention

The present invention relates to a multi-function electronic device and a method of setting the function thereof.

2. Description of the Related Art

In recent years the functional operations of various types of office equipment has diversified. For example, functions have been added that relate to the copy image form, i.e., magnification and editing, as well as functions for simple binding, such as staple functions for binding a plurality of sheets with staples, and hole punch functions for providing holes in sheets for filing.

Conventional copying machines provide operation panels having operation keys corresponding to the various functions. The operator selects a desired function and sets the predetermined value corresponding to the selected function by selecting and depressing the appropriate operation key corresponding to said desired function.

The various operation keys on the operation panel are generally arranged according to the frequency of use of the various functions, or are grouped for each device which accomplishes said functions.

Conventionally, the operator has had to personally select functions (normally not limited to a single function) suitable for a particular purpose from among a plurality of functions via sequential selection from predetermined settings. That is, an operator has had to first consider the selection of a function relative to the purpose for which the equipment is being used each time the equipment is operated.

When, for example, the purpose is to prepare materials for distribution to a plurality of conference participants, the copy number is set to correspond to the number participants receiving the material (i.e., the multi-copy function), sheet sorting is set (sorting function), and simple binding is set (staple function), and the like.

The operation of the equipment therefore becomes more complicated for the operator, and is disadvantageous inasmuch as prompt execution of the operation is compromised. Such an arrangement is further disadvantageous inasmuch as it may easily lead to omissions and errors in the function selection process, particularly when an operator is unfamiliar with the operation of the equipment.

SUMMARY OF THE INVENTION

A main object of the present invention is to provide a multi-function electronic device that is easily operable and further provides a method of setting the function thereof.

A further object of the present invention is to provide a multi-function image forming apparatus that is readily operable and further provides a method of setting the function thereof.

These objects are achieved by providing a multi-function electronic device capable of modifying the condition setting sequence in accordance with the operational purpose and further provides a method of accomplishing same.

The aforesaid objects are further achieved by providing a multi-function copying machine capable of modifying the condition setting sequence in accordance the operational purpose and further provides a method for accomplishing same.

DESCRIPTION OF THE PREFERRED EMBODIMENTS

In the following description of the preferred embodiments, an electrophotographic copying machine is used as an example of the multi-function electronic device.

Figure 1:
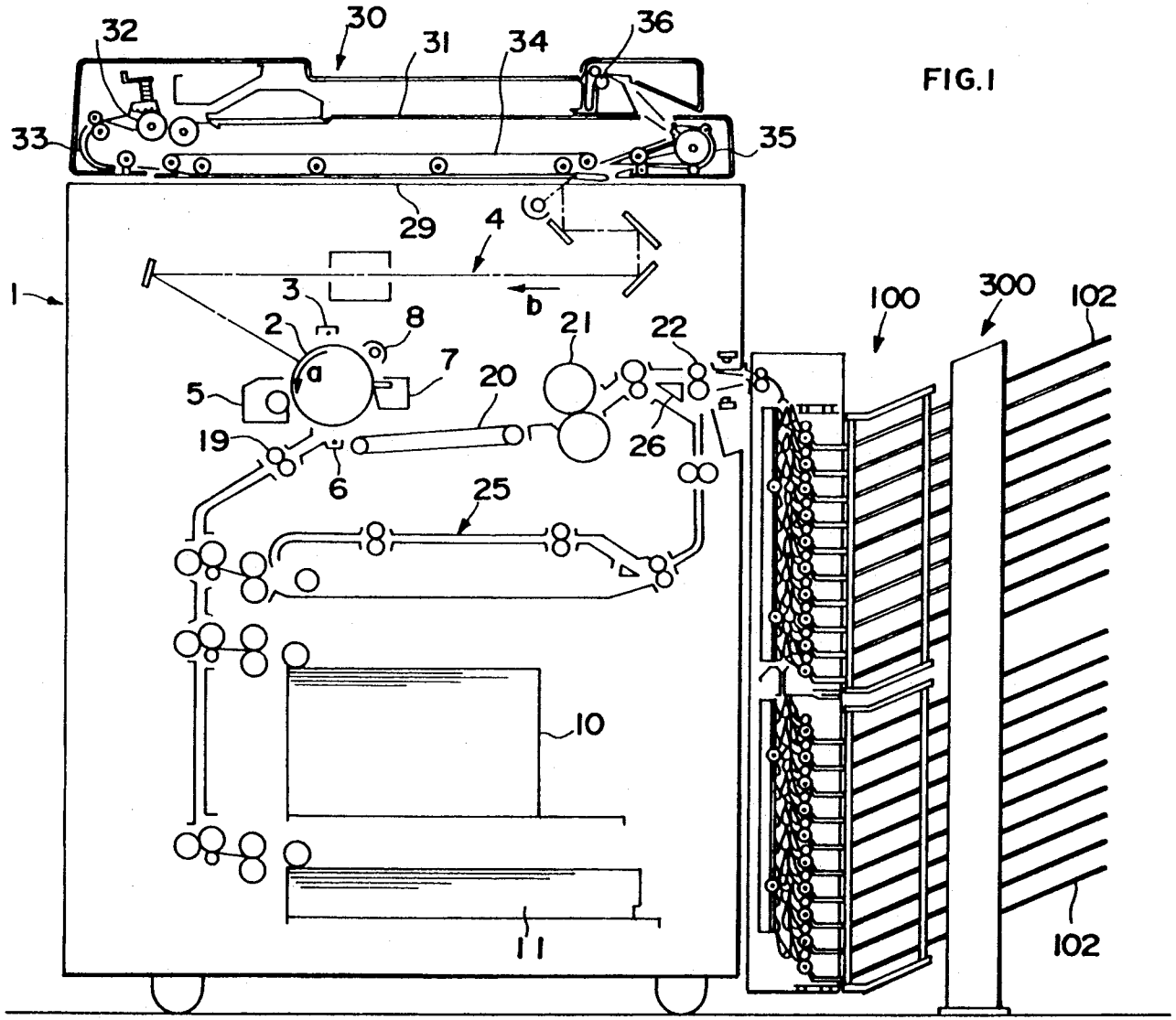
FIG. 1 is a cross section view showing the construction of an embodiment of the copying machine of the present invention.

FIG. 1 briefly shows the construction of an electrophotographic copying machine. This copying machine comprises a copying machine main unit 1, automatic document feeder 30, sorter 100, and finisher 300.

The copying machine main unit 1 is provided with elements for forming images on copy sheets. More specifically, said elements are photosensitive member 2, charger 3, optical unit 4, developing device 5, transfer charger 6, cleaner 7, eraser 8, first paper supply portion 10, second paper supply portion 11, transport device 20, fixing unit 21, discharge unit 22, sheet refeeding unit 25, paper path switching device 26, and glass platen 29. The aforesaid sheet refeeding unit 25 enables the making of duplex copies. Binding margins of copy sheets are formed by suitably changing the sheet feed timing of the paper supply portions.

The automatic document feeder 30 comprises a document tray 31, document feed portion 32, guide portion 33, transport portion 34, document inverting portion 35, and discharge portion 36. The automatic document feeder 30 particularly enables copying of duplex documents via the document inverting portion 35.

The sorter 100 is provided with a plurality of bins 102 into which the copy sheets are discharged. The finisher 300 is provided with a stamper for depressing a stamp, a punch for making holes, and a stapler for stapling copy sheets discharged into the aforesaid plurality of bins 102.

Figure 2:
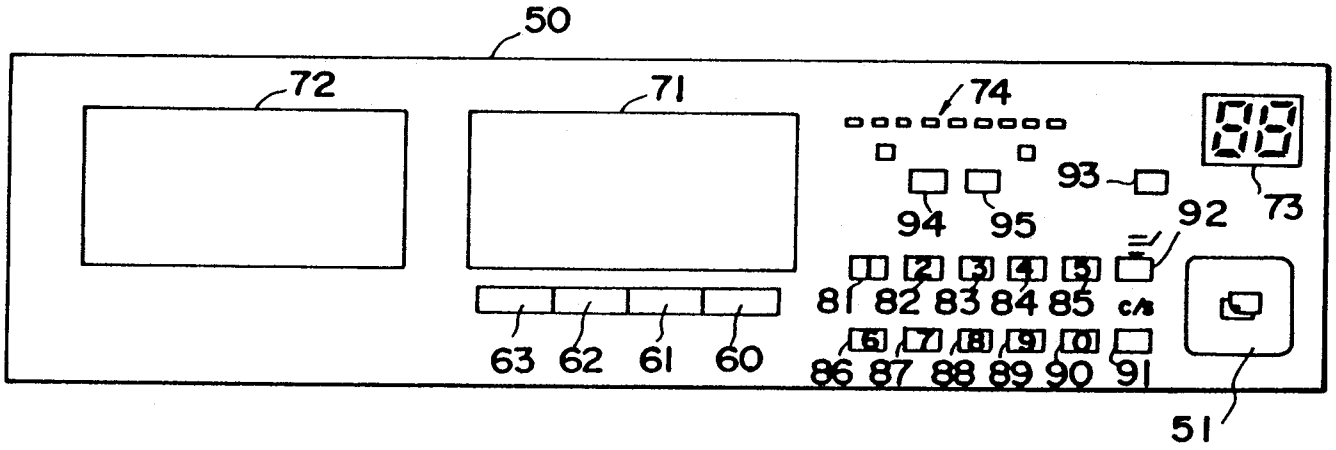
FIG. 2 is a top view of the operation panel of the copying machine.

FIG. 2 is a top view showing the operation panel 50 of the copying machine 1.

On the right side of the operation panel 50 are arranged a print key 51 for starting the copy operation, numeric keys 81 through 90 for setting the copy number and the like, clear/stop key 91 for cancelling the continuous copy (multicopy) setting, interrupt key 92, density increase key 94 and density decrease key 95 for adjusting copy density, reset key 93 for cancelling all settings made via the operation panel 50, 7-segment LED 73 for displaying the copy number, and density display LED array 74.

In the center of the operation panel 50 are arranged a first liquid crystal display (LCD) 71 capable of displaying optional characters and graphics, and selection keys 60 through 63. The LCD 71 displays messages, multiple choices and the like pertaining to the various operations. Various functions provided by the copying machine 1 are set by the operator by operating the selection keys 60 through 63 in conjunction with display screens. That is, operation is accomplished through an interactive format.

On the left side of the operation panel 50 of the present embodiment is further provided a second LCD 72 for graphically displaying the finish mode of the copy in relation to the set functions.

Figure 3:
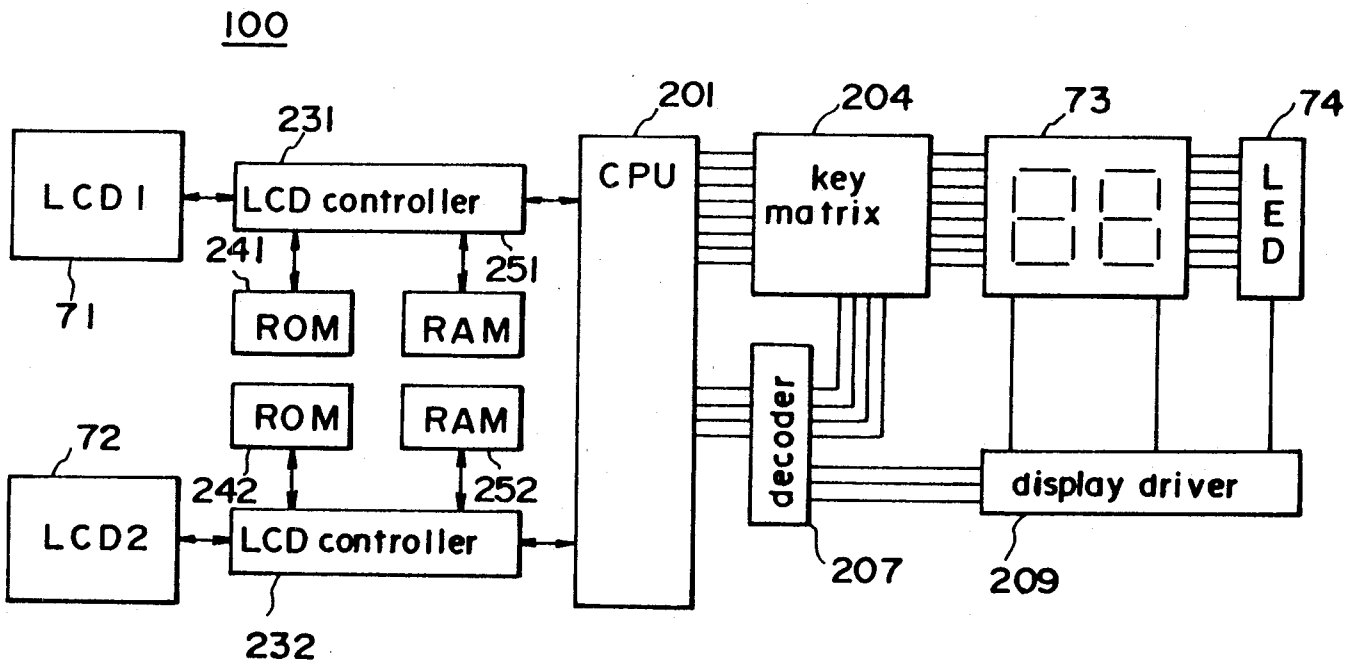
FIG. 3 is a block diagram showing the construction of the essential parts of the control portion of the copying machine.

FIG. 3 is a block diagram showing the construction of the essential parts of the control portion 100 of the copying machine.

The control portion 100 comprises a central processing unit (CPU) 201 for controlling the entirety of the copying machine 1, and key matrix 204 corresponding to the various operation keys provided on the operation panel 50, display driver 209, decoder 207 for selecting display output and key input, LCD controllers 231 and 232 corresponding to the LCDs 71 and 72, respectively, read only memories (ROM) 241 and 242 for storing display data, and random access memories (RAM) 251 and 252 used for displays.

Figure 4:
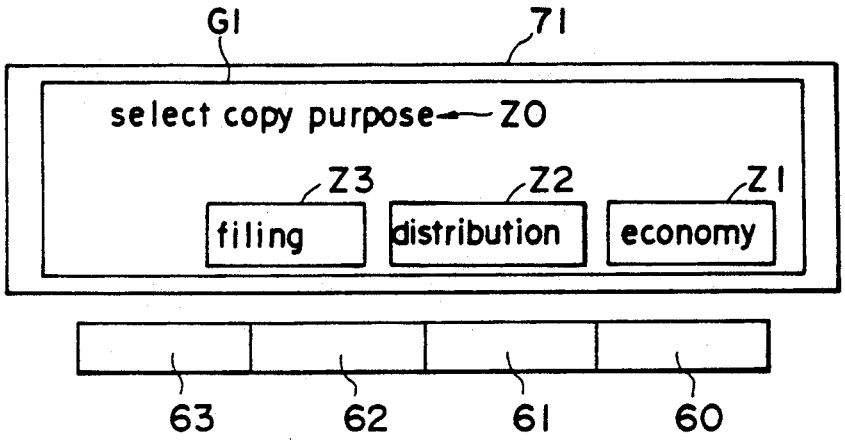
FIGS. 4*a* through 4*h* are illustrations showing the contents of the first LCD.
Figure 4:
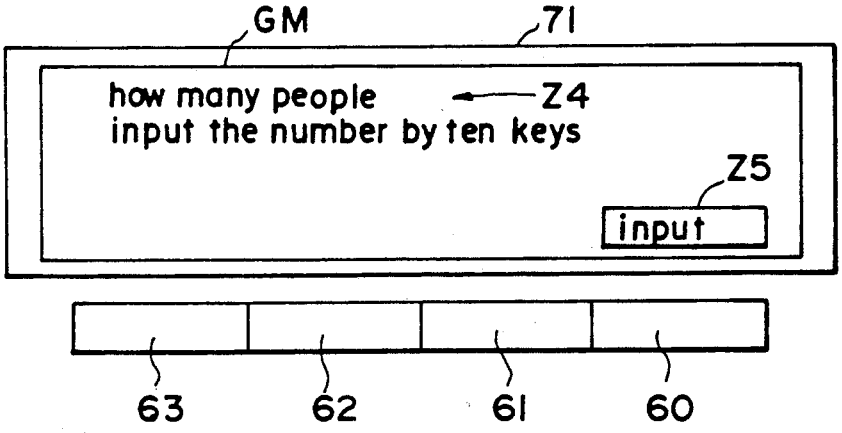
Figure 4:
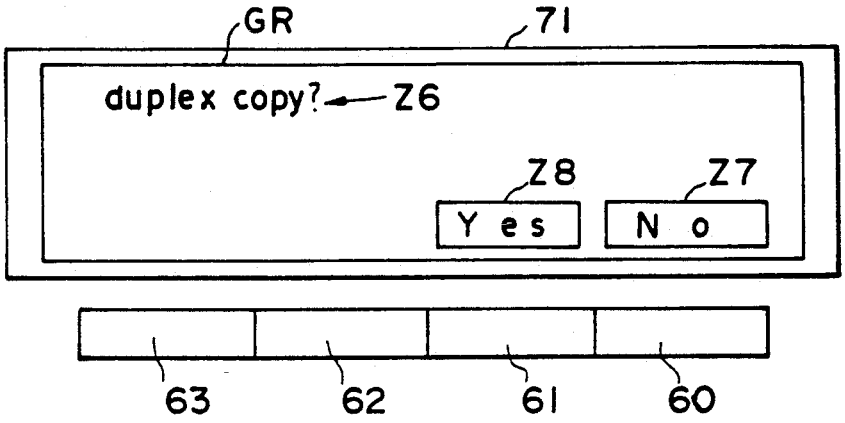
Figure 4:
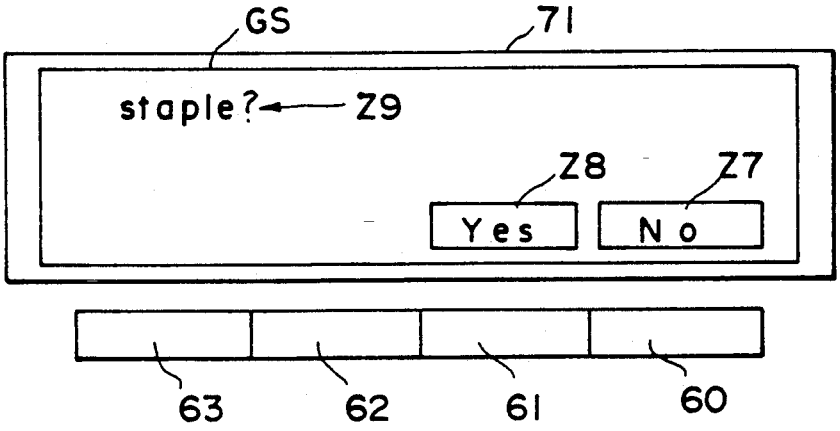
Figure 4:
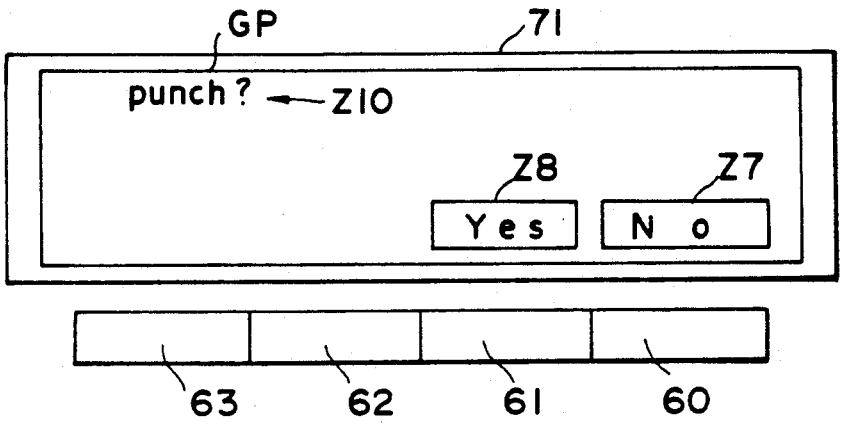
Figure 4:
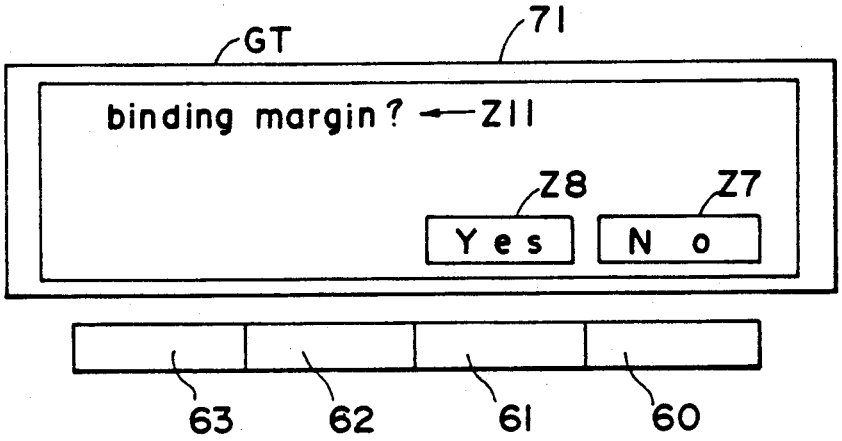

FIGS. 4*a* through 4*h* show examples of the display contents displayed by LCD 71. FIGS. 5*a* through 5*t* show examples of the display contents displayed by LCD 72.

When the copying machine is in the standby state, i.e., when key operation can be accepted, the first LCD 71 on the operation panel 50 displays the purpose selection display screen G1 for selecting the operational purpose of the copying machine.

In the present embodiment, three operational purposes are set as hypothetical copy operations relating to general office operations. One purpose is to prepare documents for filing, such as voucher memoranda, newspaper clippings and the like. A second purpose is to prepare documents for distribution such as conference materials and the like. The aforesaid purposes are closely related to the use of the copy sheets after the copy process. A third purpose is to prepare copy documents in a manner that reduces copy costs. As a convenience, in the following description the aforesaid first purpose is referred to as "filing," the second purpose is referred to as "distribution," and the third purpose is referred to as "economy."

When an operator selects a desired purpose, the screen display of the LCD 71 is switched in conjunction with said selected purpose. That is, when filing is selected as the purpose, the display (hereinafter referred to as "punch message display") GP is displayed as the first screen message display for the actual operation, inasmuch as the punch message display sets the punch function which is the most important function of the filing mode. Thereafter, the second screen display, third screen display, and the like are displayed sequentially in prioritized order corresponding to the important functions of the filing purpose and which are described in detail later.

When distribution is selected on the purpose selection screen display G1, the message display (hereinafter referred to as "copy number message display") GM is displayed as the first screen message display, inasmuch as the copy number screen display sets the continuous operation (multicopy)function which is the most important function of the distribution mode. When economy is selected on the purpose selection screen display G1, the message display (hereinafter referred to as "duplex message display") GR is displayed as the first message display, inasmuch as the duplex screen display sets the duplex copy function which is the most important function of the economy mode. When the distribution and economy modes are selected, the message displays are displayed sequentially in prioritized order corresponding to the more important functions among the remaining functions in accordance with the subsequent operation.

Figure 6:
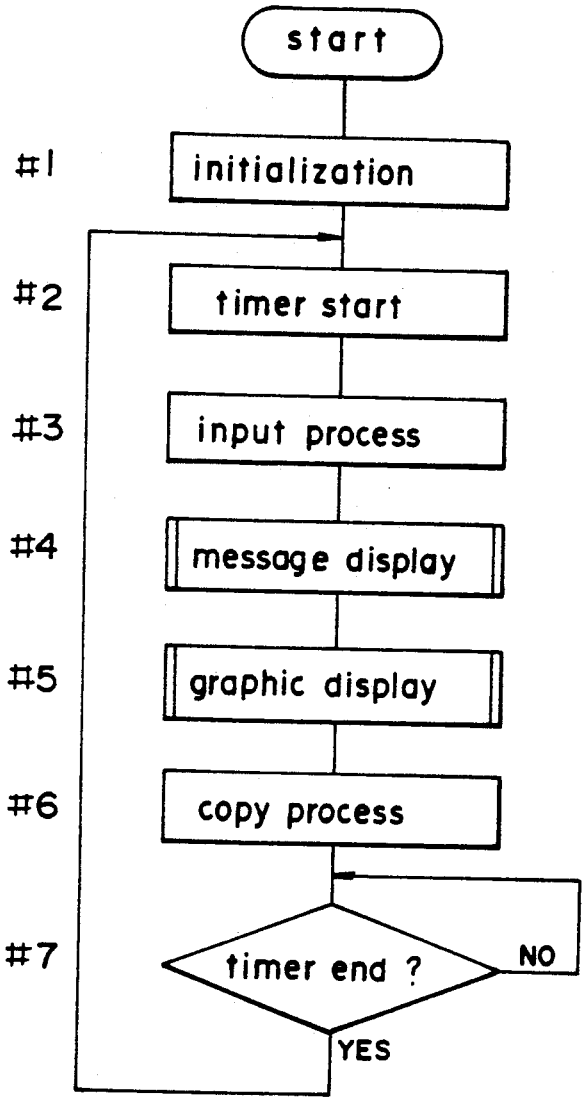
FIG. 6 is a main flow chart of the processes executed by the control portion of the copying machine.

FIG. 6 is a main flow chart briefly showing the operation of the CPU 201.

When the power is switched on and the program starts, each register, peripheral interface and the like are initialized (step #1). Then, an internal timer is set to establish the length of a single routine for the CPU 201 (step #2).

Thereafter, the following processes are sequentially executed: the input process for receiving signals output from the various operation keys on the operation panel 50 and the various sensors located in the copying machine is executed in step #3, the message display process for LCD 71 is executed in step #4, the graphic display process for LCD 72 is executed in step #5, and the copy process for controlling the electrophotographic processing is executed in step #6.

Then, the completion of the internal timer is awaited in step #7, whereupon the program returns to step #2. While power is supplied, the various processes of steps #2 through #7 are repeated with uniform periodicity.

FIGS. 7*a* through 7*e* are flow charts of the message display processes.

First, in step #11, the state is checked, and subsequent processing is executed in accordance with the state value determined via said state check.

When the state is [0], the purpose selection display G1 is displayed on LCD 71 (step #12), then the state is set at [1] (step #13). As shown in FIG. 4*a*, the purpose selection display G1 displays the message Z0 that prompts the operator to select a purpose, and the multiple choices Z1, Z2 and Z3 corresponding to economy, distribution and filing, respectively. The multiple choices Z1, Z2 and Z3 are activated via selector keys 60, 61 and 62, respectively, which are disposed in positional correlation thereto.

In state [1], the state is advanced a predetermined value in accordance with the depression (ON status) of the selector keys 60, 61 and 62. That is, when the selector key 60 is turned on, the state is set at [10] (steps #14 and #15), and when the selector key 61 is turned on the state is set at [20] (steps #16 and #17). Further, when the selector key 62 is turned on, the state is set at [30] (steps #18 and #19).

Figure 7:
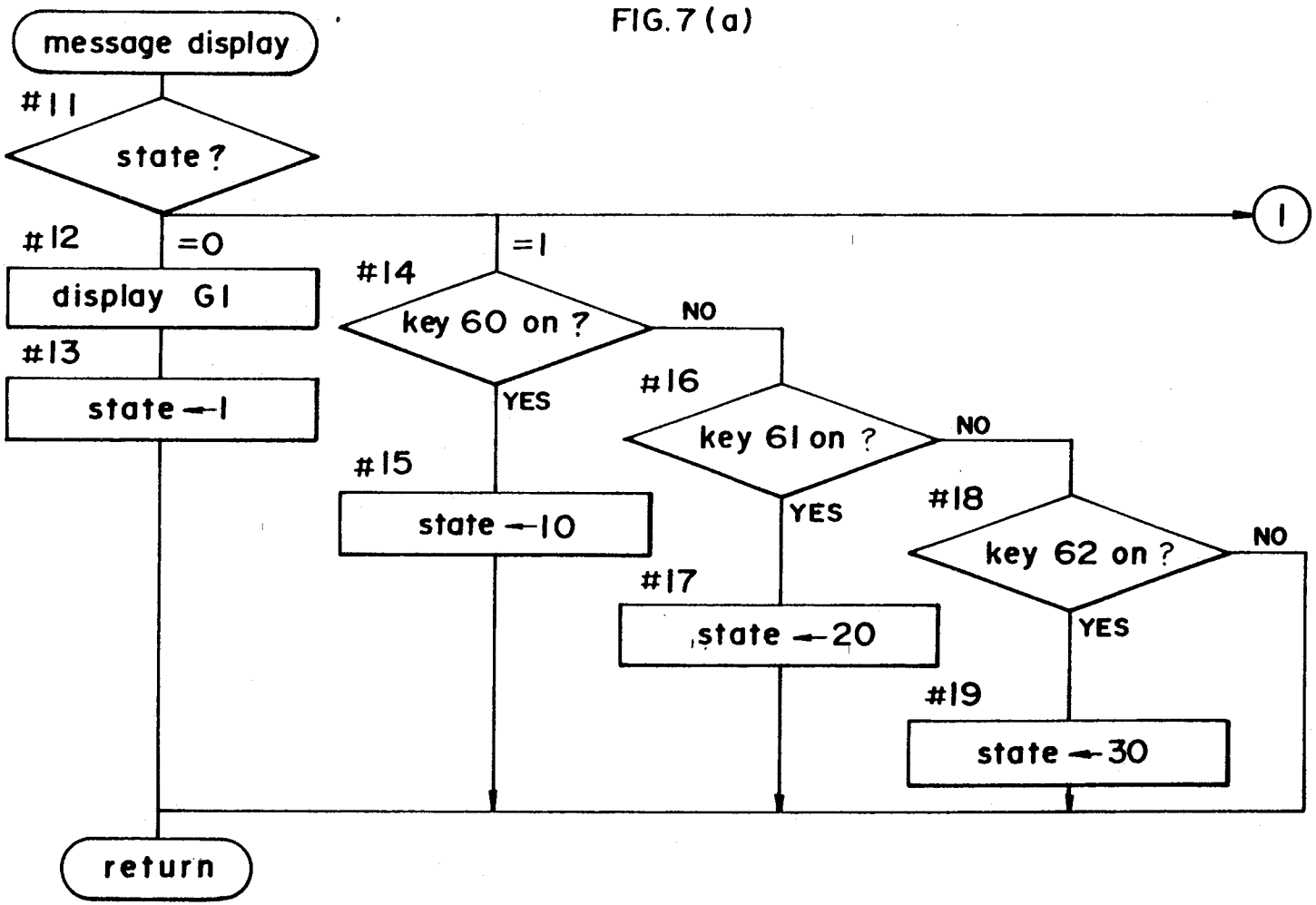
FIGS. 7*a* through 7*e* are flow charts of the message display process.
Figure 7:
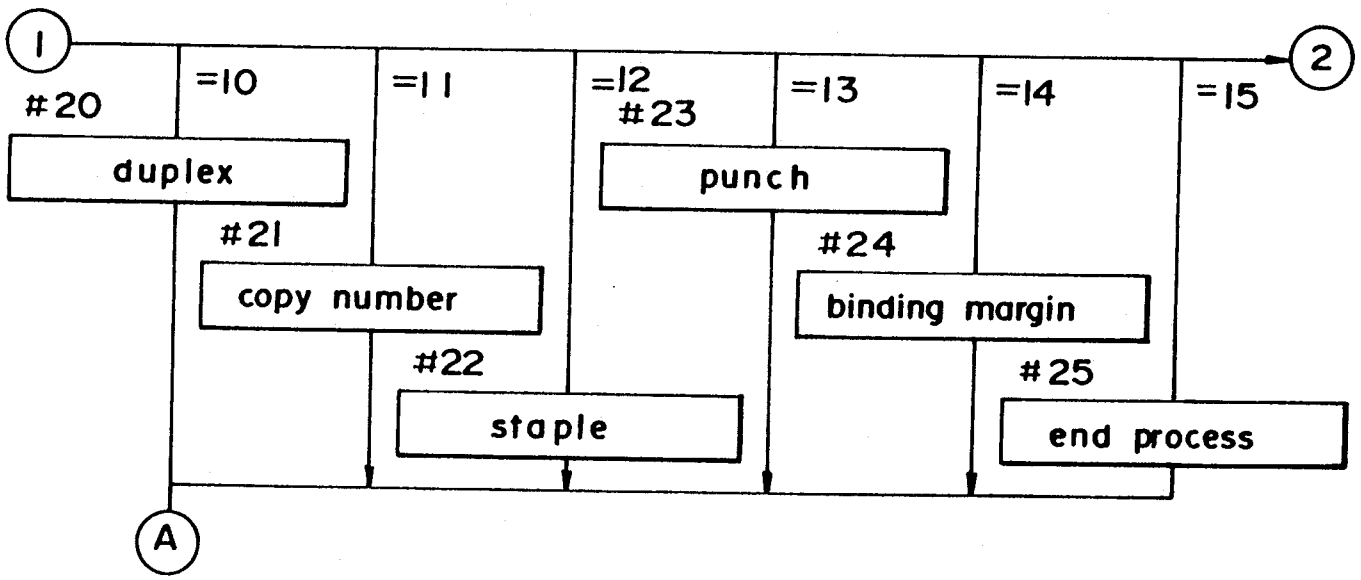
Figure 7:
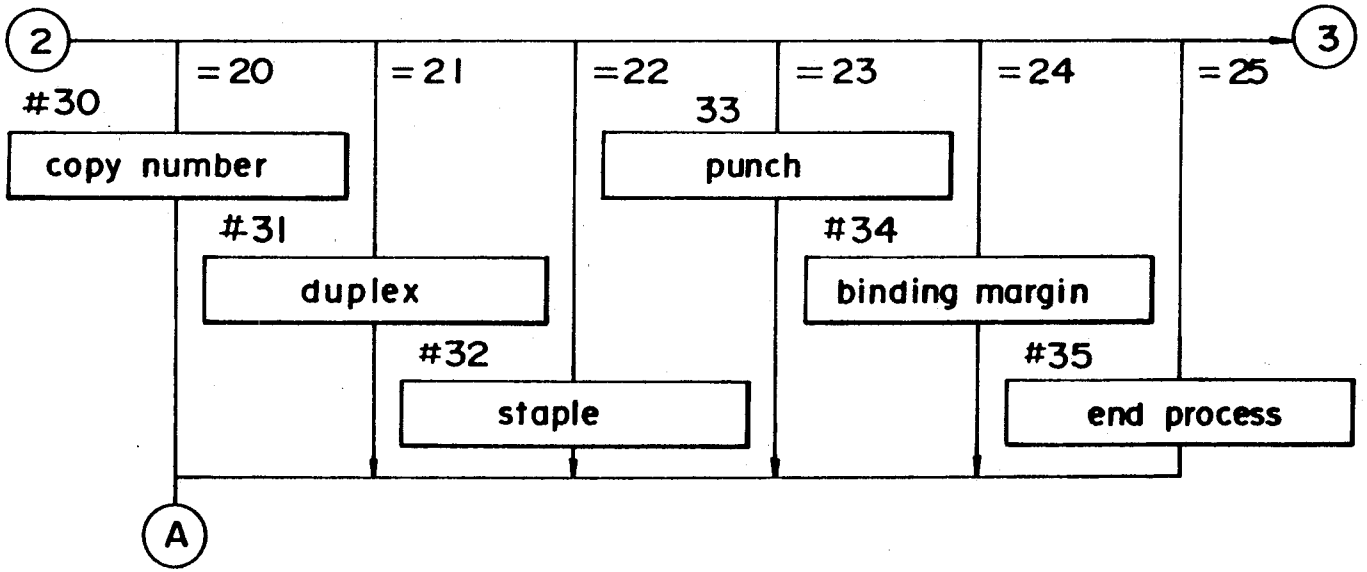
Figure 7:
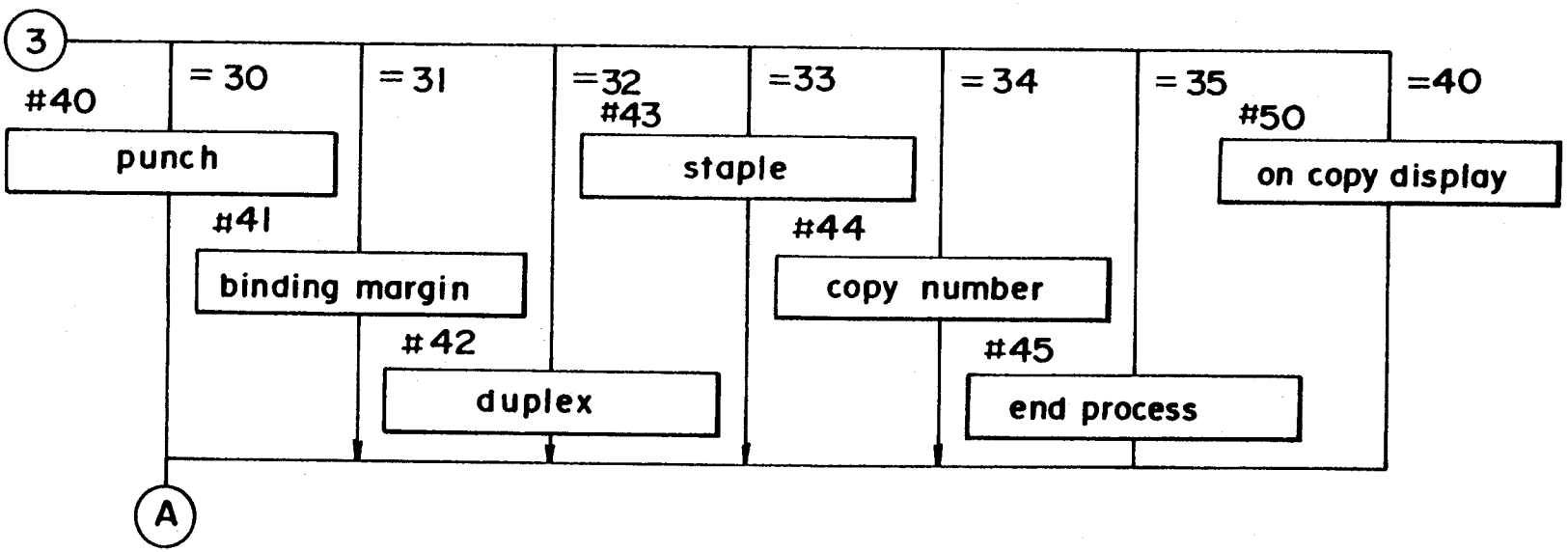
Figure 7:
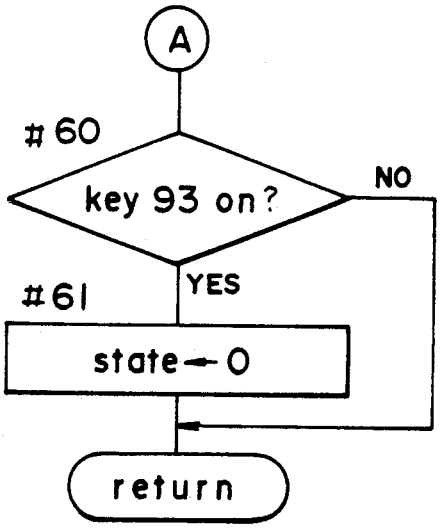

The processes of states [10] through [15] of FIG. 7*b* correspond to the economy mode. In each of these states [10] through [15], processes corresponding to single displays are executed and, thereafter, a check is made in step #60 to determine whether or not the reset key 93 is on, as shown in FIG. 7e. When the reset key 93 is on, the state is returned to the initialization value [0].

In state [10], the duplex setting process is executed (step #20) as the process corresponding to the screen display. In state [11], the copy number setting process is executed (step #21); in state [12], the staple setting process is executed (step #22); in state [13], the punch setting process is executed (step #23); in state [14], the binding margin setting process is executed (step #24); in state [15], the end process is executed (step #25).

The processes of states [20] through [25] of FIG. 7c correspond to the distribution mode. In state [20], the copy number setting process is executed (step #30); in state [21], the duplex setting process is executed (step #31); in state [22], the staple setting process is executed (step #32); in state [23], the punch setting process is executed (step #33); in state [24], the binding margin setting process is executed (step #34); in state [25], the end process is executed (step #35).

The processes of states [30] through [35] of FIG. 7d correspond to the filing mode. In state [30], the punch setting process is executed (step #40); in state [31], the binding margin setting process is executed (step #41); in state [32], the duplex setting process is executed (step #42); in state [33], the staple setting process is executed (step #43); in state [34], the copy number setting process is executed (step #44); and in state [35], the end process is executed (step #45). Furthermore, in state [40], the on copy (on-going copy) display process is executed (step #50).

Figure 8:
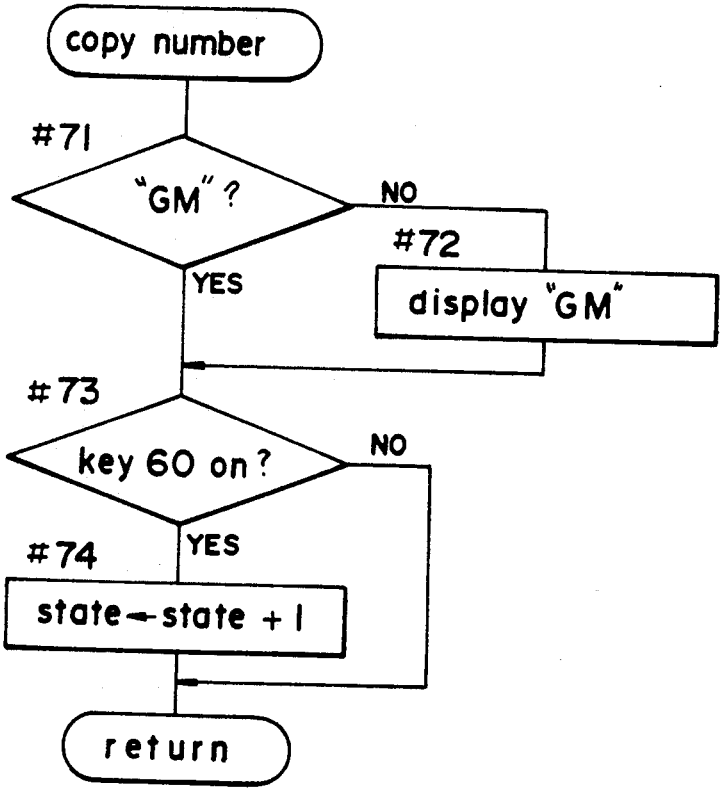
FIG. 8 is a flow chart showing the copy number process.

FIG. 8 is a flow chart of the copy number setting process corresponding to the aforesaid steps #21, #30 and #44. First, a check is made to determine whether or not the copy number setting display GM is displayed on the LCD 71 (step #71). If the copy number setting display GM is not displayed, said screen display GM is thereupon displayed via the LCD controller 231 (step #72).

As shown in FIG. 4b, the copy number setting display GM displays a message Z4 to prompt the operator to set the copy number via the ten-key pad (i.e., numeric keys 81 through 90), and symbol Z5 (the boxed word "input") indicating that the copy number execution key is selector 60.

Then, a check is made to determine whether or not the selector key 60 is on (step #73). If the selector key 60 is on, the current state value is incremented by 1 and set.

Figure 9:
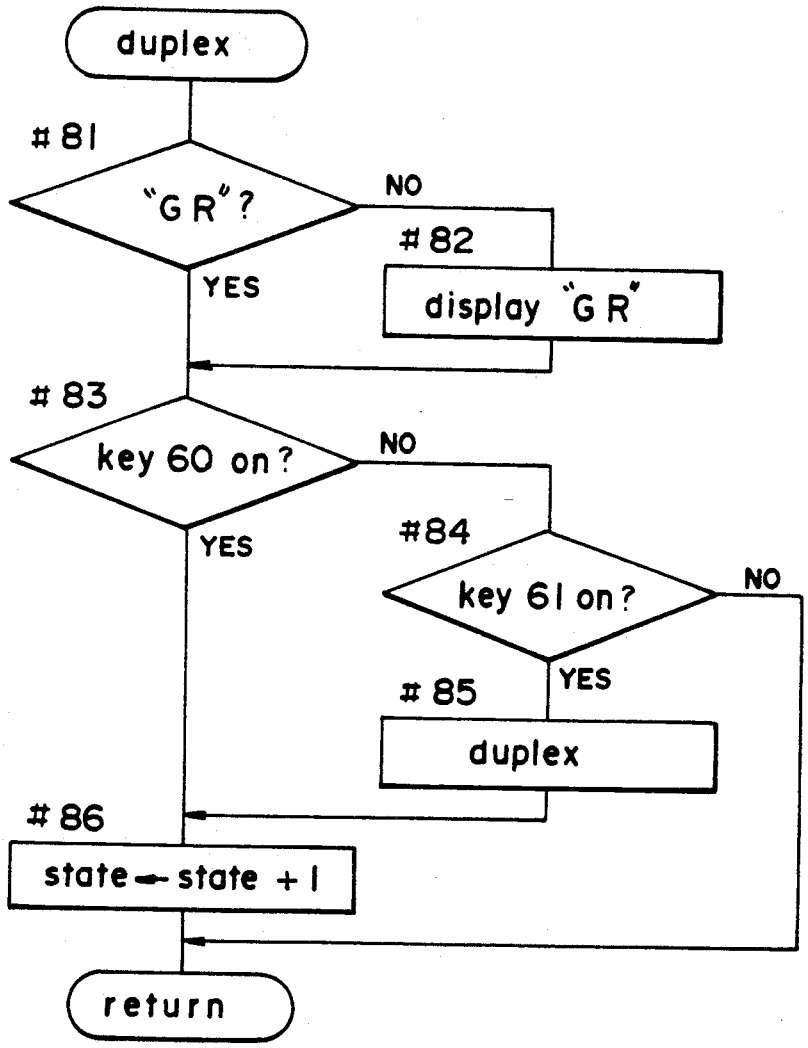
FIG. 9 is a flow chart showing the duplex process.

FIG. 9 is a flow chart of the duplex setting process corresponding to the previously mentioned steps #20, #31 and #42.

First, a check is made to determine whether or not the duplex setting display GR is displayed on the LCD 71 (step #81). If the duplex setting display GR is not displayed, said screen display GR is thereupon displayed (step #82).

As shown in FIG. 4c, the duplex setting display GR displays a message Z6 to ask the operator whether or not the duplex copy operation is to be executed to form copy images on both the front and back sides of the copy sheet, and displays two alternative multiple choices Z7 and Z8. The aforesaid multiple choices Z7 and Z8 respectively correspond to the selector keys 60 and 61.

When the selector key 60 is on, i.e., when the duplex copy setting is unnecessary, the state is immediately incremented (steps #83 and #86). On the other hand, when the selector key 61 is on, the settings for each portion related to duplex copying are executed (steps #84 and #85).

Although the previously described staple setting process (corresponding to steps #22, #32 and #43), punch setting process (corresponding to steps #23, #33, #40), and binding margin setting process (corresponding to steps #24, #34 and #41) are omitted in the drawings, the message screen displays for each setting process, and the settings corresponding to the on state of the selector key 61 and the like are executed as shown in FIG. 9.

That is, in the staple setting process, the staple setting message display GS is displayed which comprises a message Z9 that asks whether or not binding is required, and multiple choices Z7 and Z8, as shown FIG. 4d. Then, the mechanical portions relating to the stapling operation are actuated during copying by the aforesaid settings in accordance with the on state of the selector key 61.

Further, in the punch setting process, the punch setting message display GP is displayed which comprises a message Z10 that asks whether or not hole punching is required, and multiple choices Z7 and Z8, as shown in FIG. 4e. Then the mechanical portions relating to hole punching are actuated by the aforesaid settings in accordance with the on state of the selector key 61.

In the binding margin setting process, the binding margin setting message display GT is displayed which comprises a message Z11 that asks whether or not the sheets are to be bound, i.e., whether or not the copy image should be offset to one side of the sheet, and multiple choices Z7 and Z8, as shown in FIG. 4f. Then, the settings are set to execute the binding margin in accordance with the on state of the selector key 61.

Figure 10:
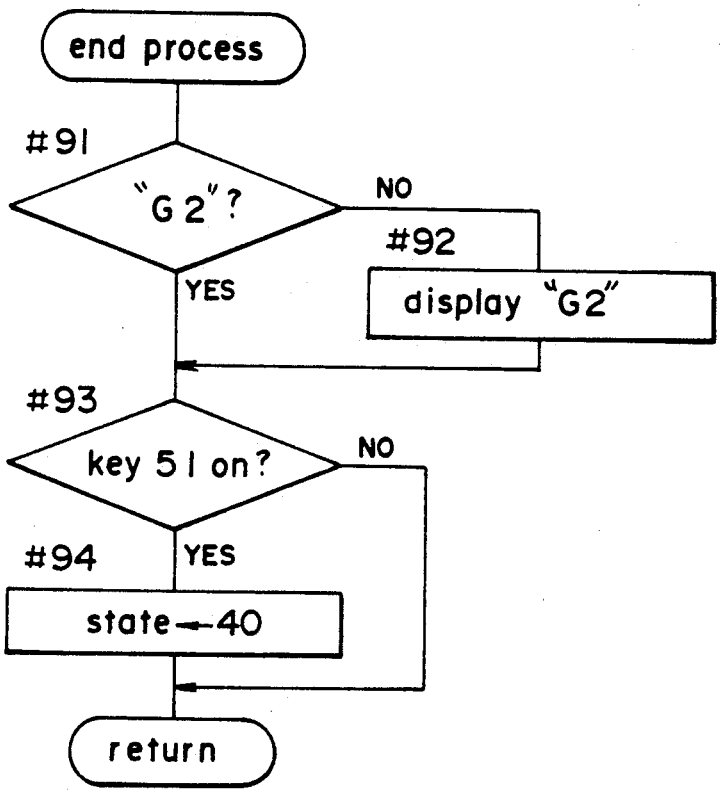
FIG. 10 is a flow chart showing the end process.

FIG. 10 is a flow chart showing the end process corresponding to the previously described steps #25, #35 and #45.

Figure 4G:
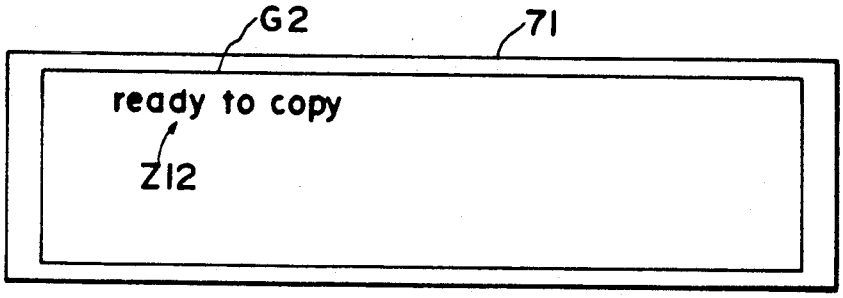
Figure 4:
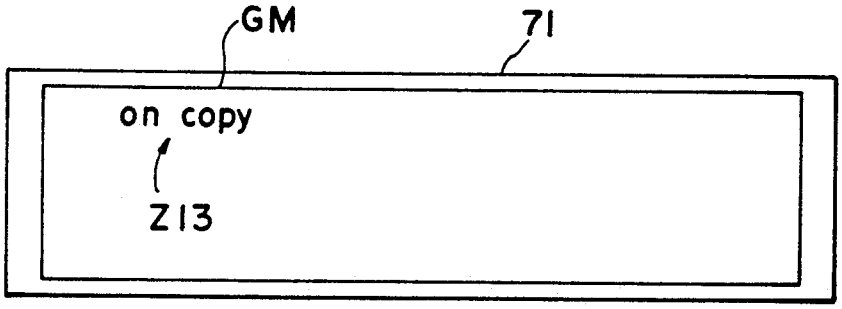
Figure 5:
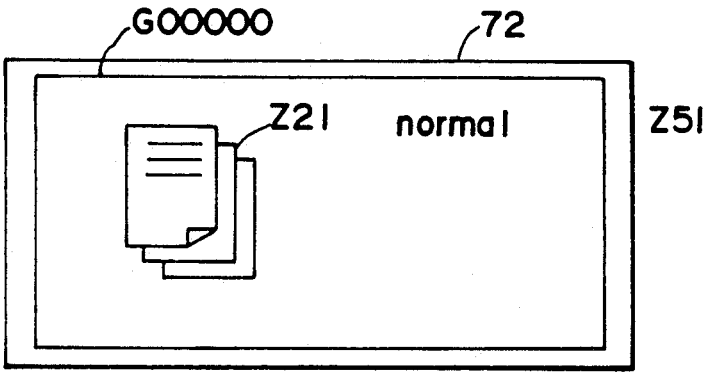
FIGS. 5*a* through 5*t* are illustrations showing the contents of the second LCD.
Figure 5:
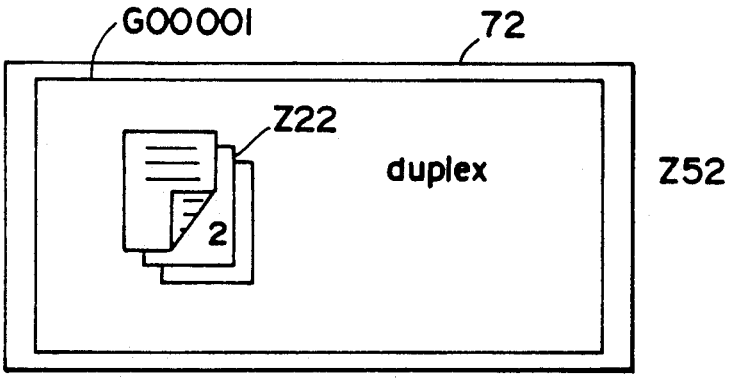
Figure 5:
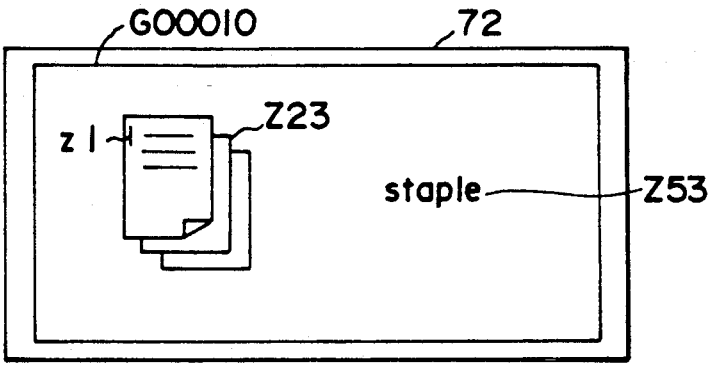
Figure 5D:
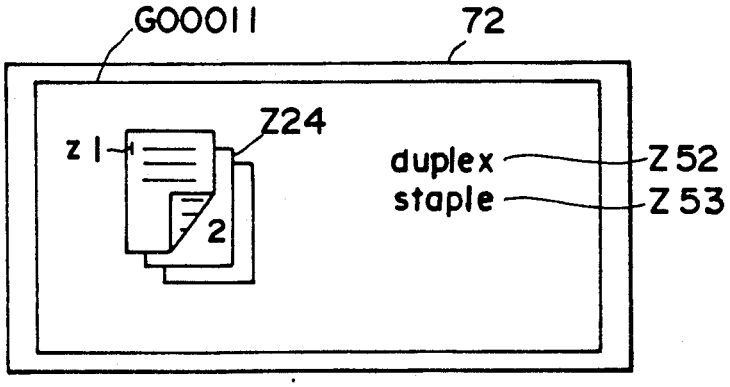
Figure 5:
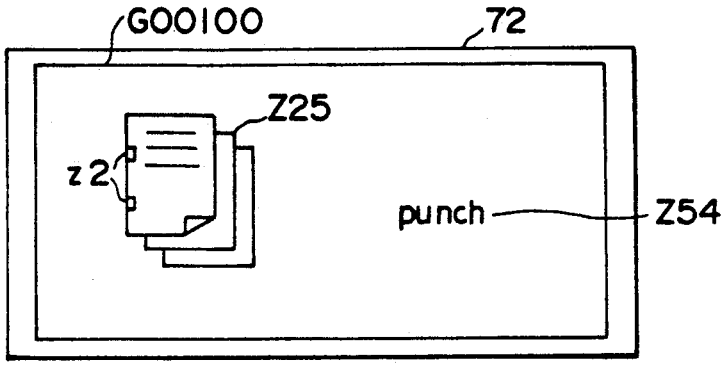

First, a check is made to determine whether or not the end message display G2 is currently displayed, as shown in FIG. 4g (step #91). If the end message display G2 is not displayed, said screen display G2 is thereupon displayed in step #92.

When the setting are completed for the various functions in accordance with the operation purpose of the copying machine 1, the end process message display G2 displays a message Z12 indicating the standby state wherein the copying machine 1 awaits the operation of the print key 51.

When the print key 51 is depressed so as to be switched on, the state proceeds to [40] (steps #93 and #94).

Figure 11:
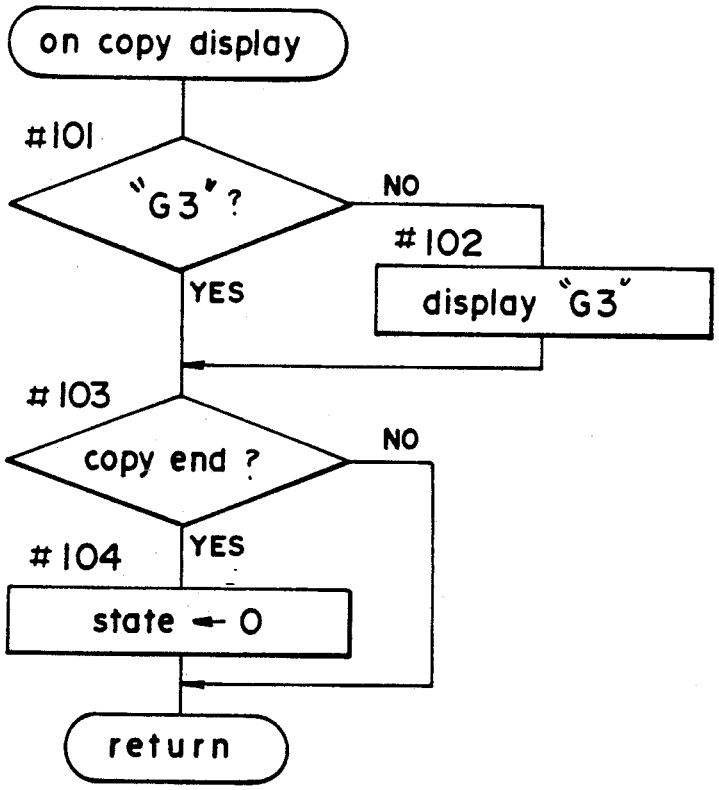
FIG. 11 is a flow chart showing the ON COPY display process.

FIG. 11 is a flow chart showing the on copy display process corresponding to step #50 of FIG. 7d.

First, a check is made to determine whether or not the on copy display G3 is currently displayed, as shown in FIG. 4h (step #101). If the on copy display G3 is not currently displayed, said screen display is thereupon displayed in step #102. The on copy display G3 displays a message Z13 indicating that a copy operation is currently being executed.

When the copy operation is completed, the state returns to the initialization state value [0] (steps #103 and #104).

Figure 12:
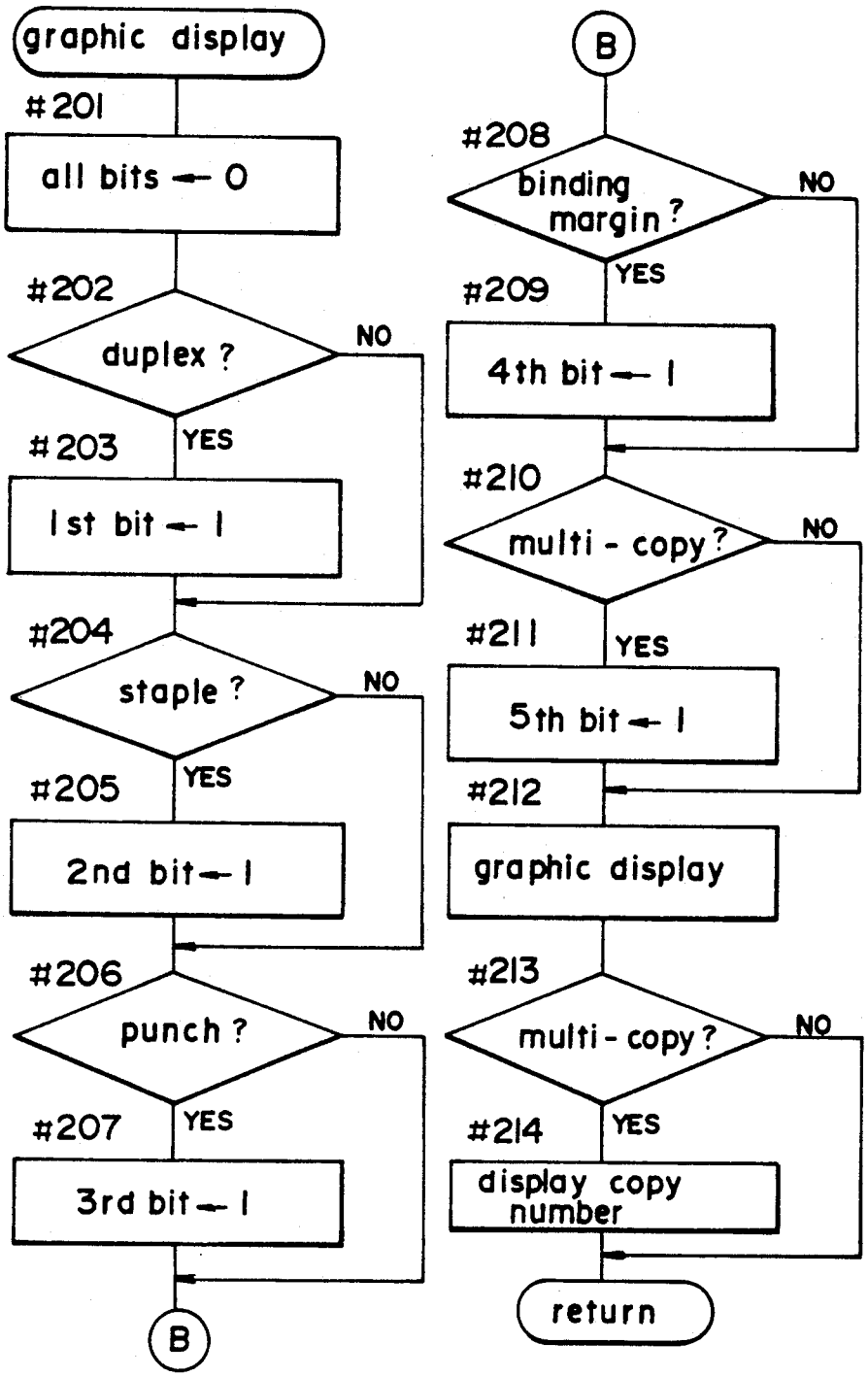
FIG. 12 is a flow chart showing the graphic display process.

FIG. 12 is a flow chart showing the screen display process of FIG. 6.

First, the 5-bit flag KINOU is initialized. That is, all five bits of the flag KINOU are set at [0] (step #201). Thereafter, when the duplex copy mode is set, the first bit (least significant bit) of the flag KINOU is set at [1] (steps #202 and #203). When the staple mode is set, the second bit of the flag KINOU is set at [1] (steps #204 and #205). When the punch mode is set, the third bit of the flag KINOU is set at [1] (steps #206 and #207).

When the binding margin mode is set, the fourth bit of the flag KINOU is set at [1] (steps #208 and #209). When the multicopy mode is set, the fifth bit (most significant bit) of the flag KINOU is set at [1] (steps #210 and #211).

Subsequently, a graphic display is executed on the LCD 72 in accordance with the value of the flag KINOU. When the multicopy mode is set, the copy number (or part number) set via the numeric ten-key pad is displayed in conjunction with the aforesaid graphic display on the LCD 72 (steps #212 through #214).

In FIGS. 5*a* through 5*t*, the letter G and five digit numerals (binary numbers) corresponding to the value of the flag KINOU are attached in a character string as a symbol for each of the screen displays.

When the value of the flag KINOU is [00000B] in the previously mentioned step #212, the graphic display G00000 is displayed on the LCD 72, as shown in FIG. 5*a*. At this time, the basic copy operation, i.e., image formation for a single original document sheet, corresponds to only a single cycle operation. The graphic display G00000 displays a graphic Z21 showing the finished form of the copy (at this time, the form wherein images are formed only on a single side of the copy sheet), and a function name Z51 corresponding to the currently set function.

The graphic display G00001 of FIG. 5*b* displays a graphic Z22 and a function name Z52 to indicate the duplex copy mode is set. The graphic display G00010 of FIG. 5*c* displays a graphic Z23 and a function name Z53 to show the staple mode is set. The graphic Z23 provides an graphic z1 added to the graphic Z21 to indicate a staple. Furthermore, the graphic screen G00011 displays a graphic Z24 added to the graphic Z22, and the function names Z52 and Z53.

Figure 5F:
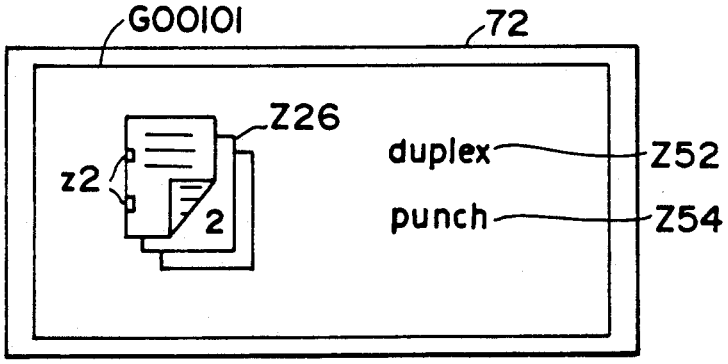
Figure 5:
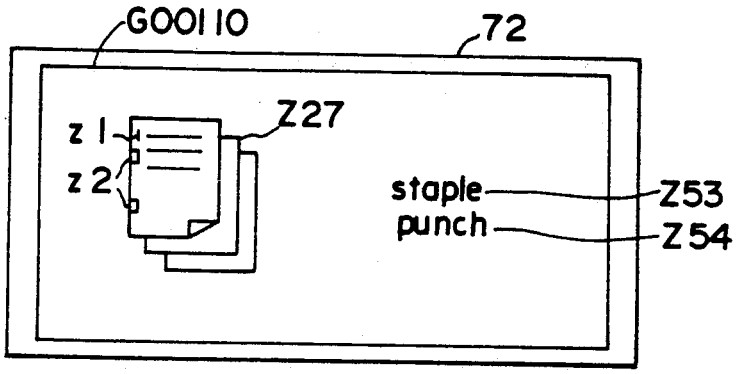
Figure 5H:
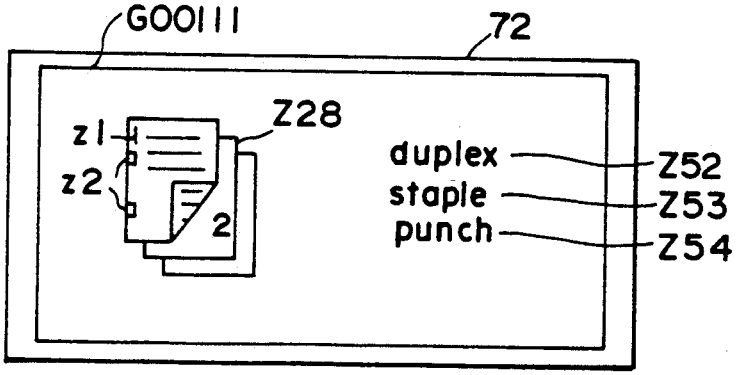
Figure 5:
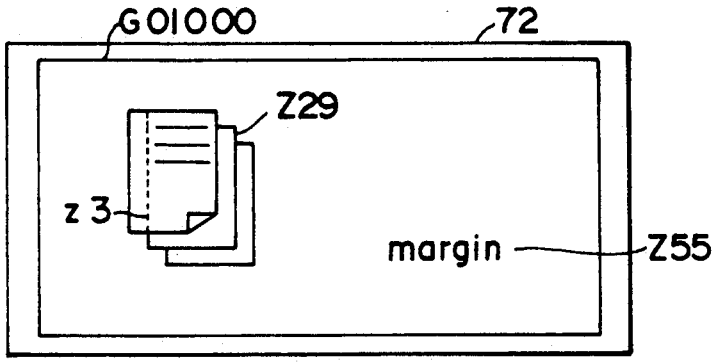
Figure 5:
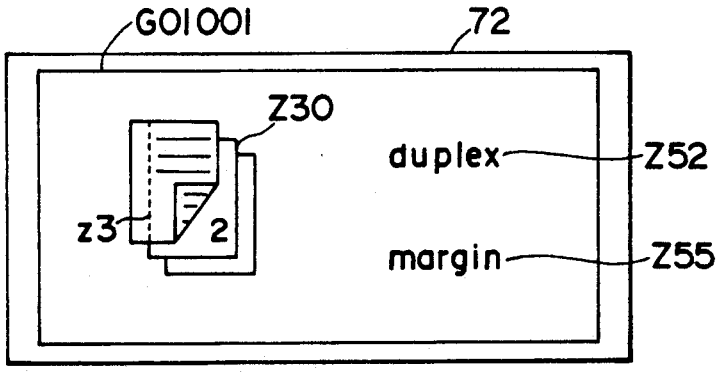
Figure 5:
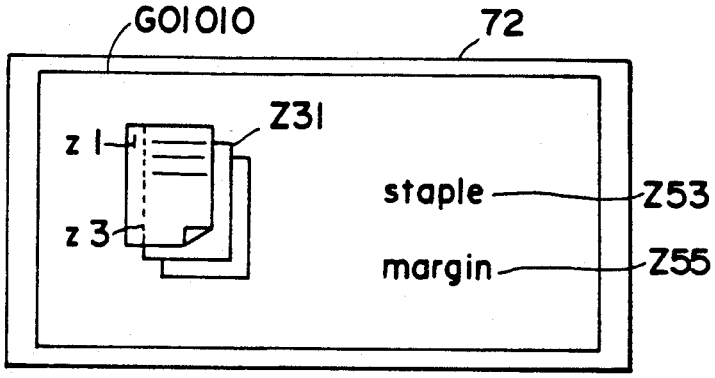
Figure 5:
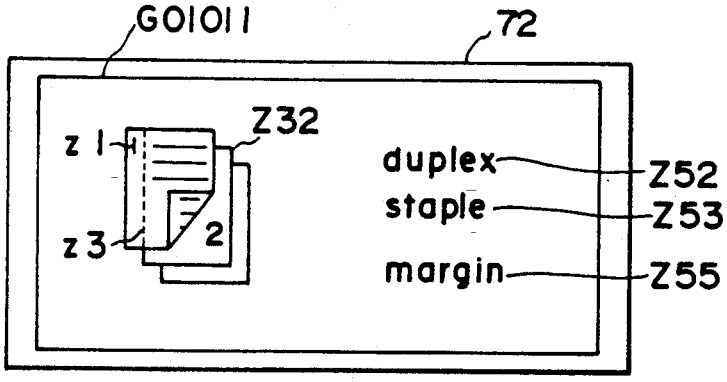
Figure 5:
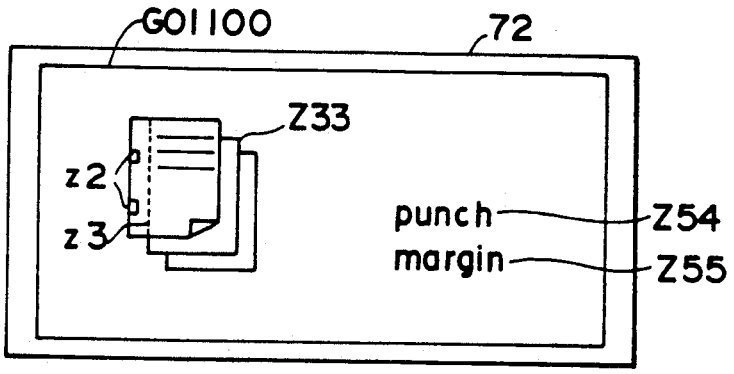
Figure 5:
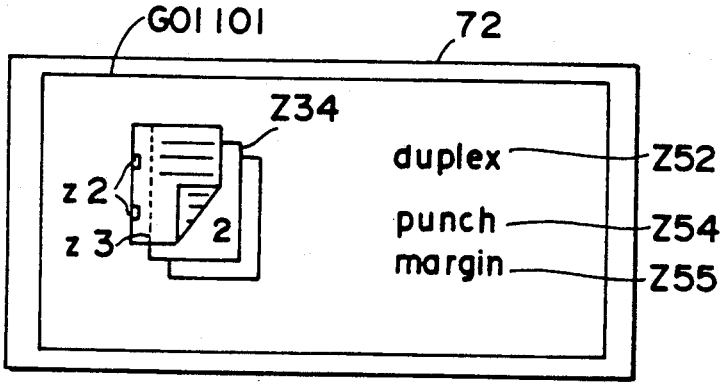
Figure 5:
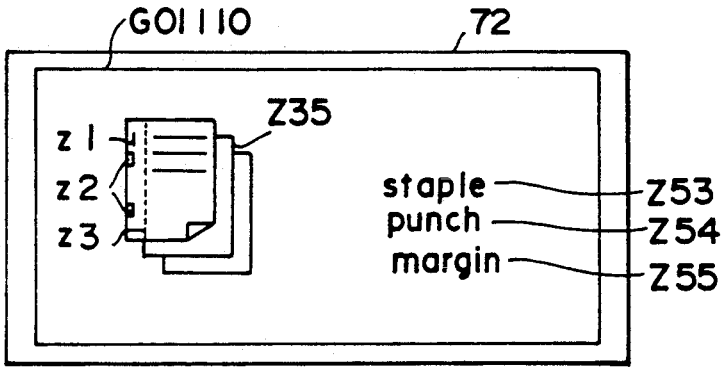
Figure 5:
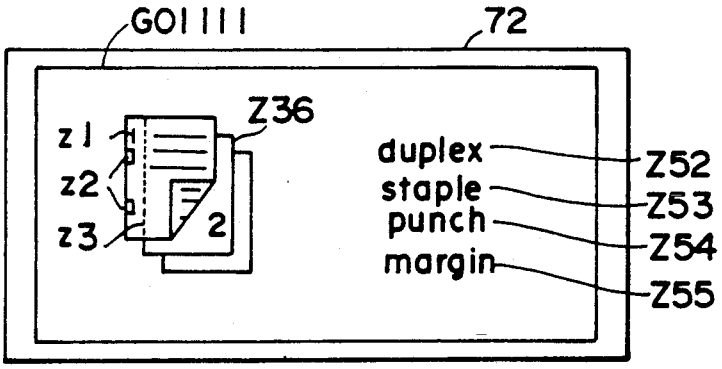
Figure 5:
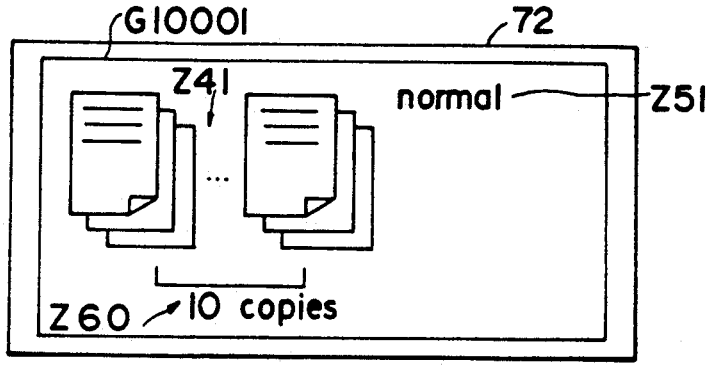
Figure 5:
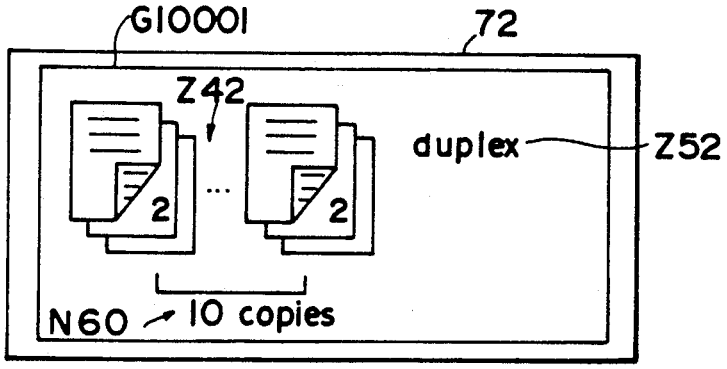
Figure 5:
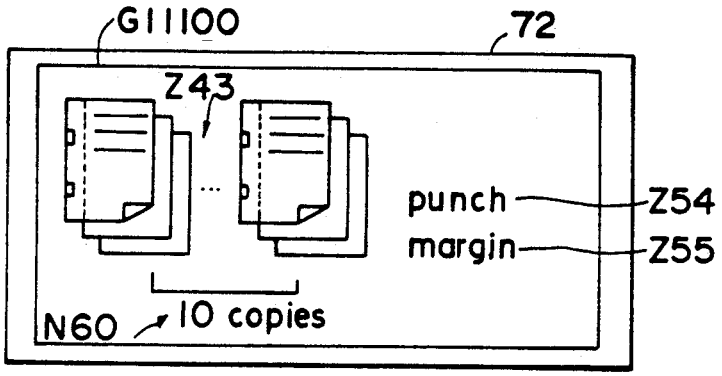
Figure 5T:
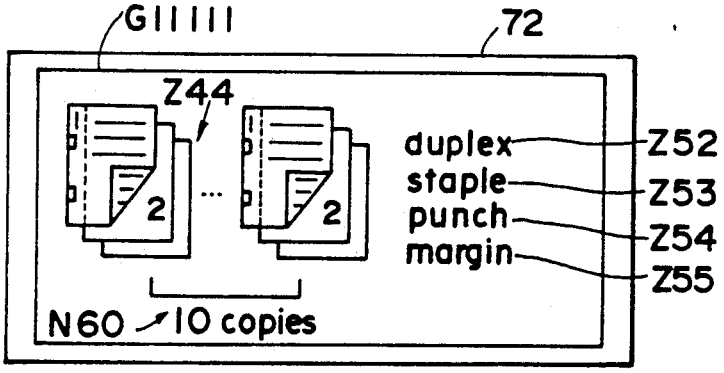

The graphic display G00100 of FIG. 5*e* displays a graphic Z25 and function name Z54 to indicate the hole punch mode is set. The graphic Z25 provides graphics z2 added to the graphic Z21 to indicate the punch holes. The graphic displays G00101, G00110 and G00111 of FIGS. 5*f* through 5*h* respectively display the graphics Z26, Z27 and Z28.

The graphic display G01000 of FIG. 5*i* displays a graphic Z29 and a function name Z55 to indicate the binding margin mode is set. The graphic Z29 provides a graphic z3 added to the graphic Z21 to indicate the binding margin mode.

The graphic displays G01001, G01010 and G01011 of FIGS. 5*j* through 5*l* respectively display the graphics Z30, Z31 and Z32. Furthermore, the graphic displays G01100, GO1101, G01110 and G01111 of FIGS. 5*m* through 5*p* respectively display the graphics Z33, Z34, Z35 and Z36.

The graphic displays G10000, G10001, G11100 and G11111 of FIGS. 5*q* through 5*t* correspond to the continuous copy mode and display numerals N60 (numeral "10" in the drawings) indicating the copy number (number of parts) set via the ten-key pad in addition to the graphics Z41, Z42, Z43 and Z44, respectively.

Figure 13:
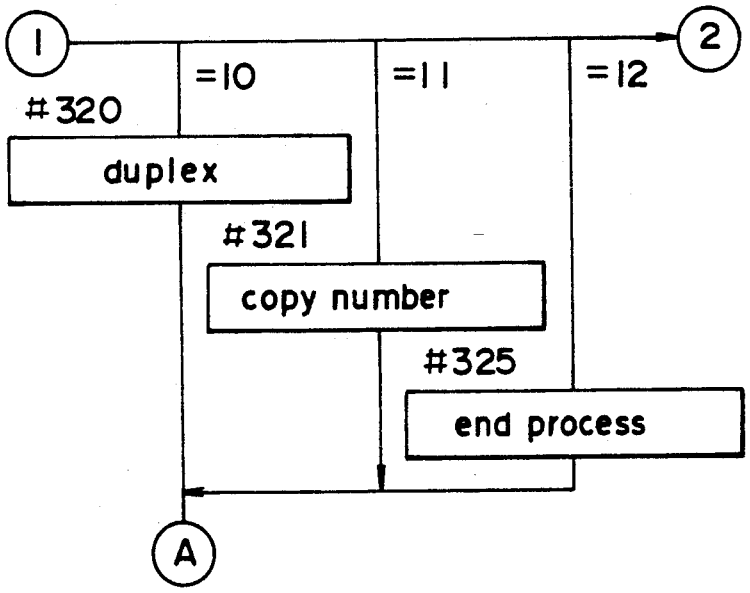
FIGS. 13*a* through 13*c* are flow charts showing other embodiments of the message display process.
Figure 13:
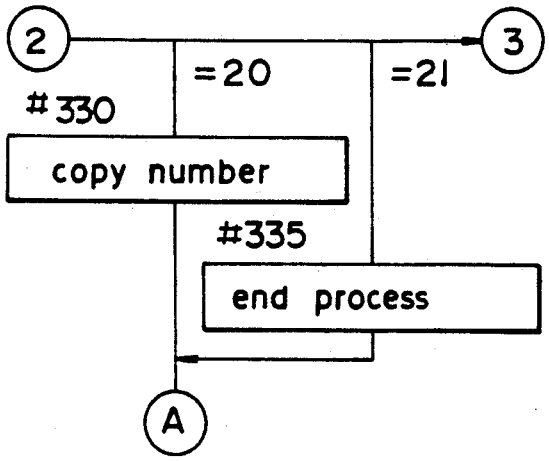
Figure 13:
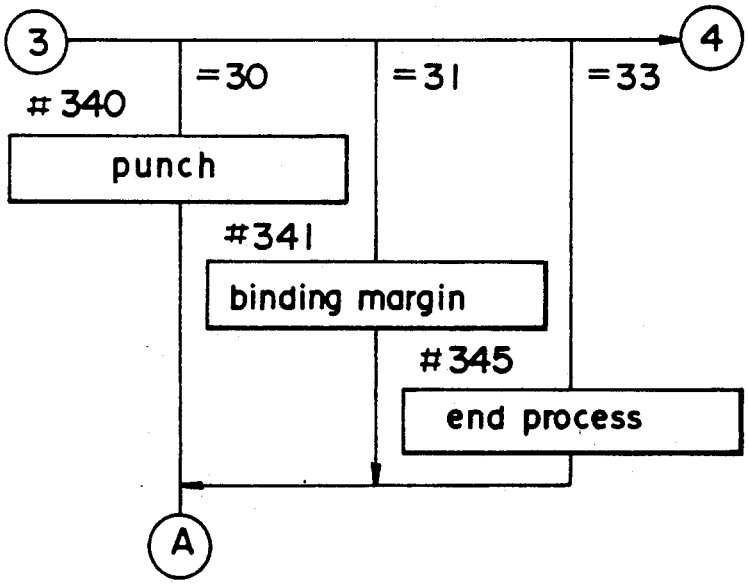

FIGS. 13*a* through 13*c* are flow charts showing parts of the message display process of another embodiment of the invention.

In the message display processes shown in FIGS. 7*b* through 7*d*, the display sequence of LCD 71 differs according to the operational purpose of the copying machine, although the number of displays displayed according to the operation is equal among the three purposes. Conversely, the number of screen displays, i.e., the number of functions which are the objects of the setting process, are suitably selectable according to the operational purpose.

That is, in the economy mode, the duplex setting process (step #320), copy number setting process (step #321), and end process (step #325) shown in FIG. 13*a* are executed instead of the processes of steps #20 through #25 of FIG. 7*b*.

In the distribution mode, the duplex setting process (step #330) and the end process (step #335) of FIG. 13*b* are executed instead of the setting processes of steps #30 through #35 of FIG. 7*c*.

In the filing mode, the punch setting process (step #340), binding margin setting process (step #341) and end process (step #345) of FIG. 13*c* are executed instead of the processes of steps #40 through 45 of FIG. 7*d*.

According to above the description of the embodiments, the operator only selects an operational purpose, and thereafter the operation is not only executed according to the display of LCD 71, but the functions themselves suited to the aforesaid selected purpose need not be selected from among the plurality of functions provided by the copying machine. Furthermore, since the respective purposes are displayed in prioritized sequences in relation to the most important functions, the most important settings can be completed at the initial stage, thereby allowing the operator to quickly proceed with the operation.

According to the embodiment shown in FIGS. 13*a* through 13*c*, the operator manual operations are reduced, thereby allowing the copy operation to be rapidly initiated.

What is claimed is:

1. An electronic apparatus including a plurality of purposes and a plurality of conditions selectable by an operator in order to realize suitable operations corresponding to one of said plurality of purposes required by the operator, the electronic apparatus comprising:

input means for inputting one of said plurality of purposes;

said conditions being selectable independently of each other;

deciding means for deciding a setting order of said plurality of conditions in response to the purpose selected by the input means;

assisting means for assisting the operator in selecting said plurality of conditions in the decided setting order.

2. The electronic apparatus claimed in claim 1, further comprising a condition input means for inputting conditions selected by the operator.

3. The electronic apparatus claimed in claim 2, wherein said assisting means displays a plurality of messages sequentially in response to the condition input means.

4. The electronic apparatus claimed in claim 1, further comprising a means for requesting the operator to input one of said plurality of purposes.

5. In an electronic apparatus including a plurality of purposes and a plurality of conditions selectable independently of each other by an operator in order to realize suitable operations corresponding to one of said plurality of purposes required by the operator, a method comprising the steps of:

requesting the operator to select one of said plurality of purposes;

deciding a setting order of said plurality of conditions in response to the purpose selected by the operator, assisting the operator in selecting independently of each other said plurality of conditions in the decided setting order.

6. A copying apparatus including a plurality of copy purposes and a plurality of copy conditions selectable by an operator in order to realize suitable operations corresponding to one of the plurality of copy purposes required by the operator, the copying apparatus comprising:

means for inputting one of said plurality of copy purposes;

said conditions being selectable independently of each other;

means for deciding a setting order of said plurality of copy conditions in response to the copy purpose selected by the input means;

means for assisting the operator in selecting said plurality of copy conditions in the decided setting order.

7. The copying apparatus claimed in claim 6, further comprising a condition input means for inputting copy conditions selected by the operator.

8. The copying apparatus claimed in claim 7, wherein said assisting means displays a plurality of messages sequentially in response to the condition input means.

9. The copying apparatus claimed in claim 6, further comprising a means for requesting the operator to input one of said plurality of copy purposes.

10. In a copying apparatus including a plurality of copy purposes and a plurality of copy conditions selectable independently of each other by an operator in order to realize suitable operations corresponding to one of said plurality of copy purposes required by the operator, a method comprising the steps of:

requesting the operator to select one of said plurality of copy purposes;

deciding a setting order of said plurality of copy conditions in response to the copy purpose selected by the operator;

assisting the operator in selecting independently of each other said plurality of copy conditions in the decided setting order.

* * * * *